US005803997A

United States Patent [19]

Haszler et al.

[11] Patent Number: 5,803,997

[45] Date of Patent: Sep. 8, 1998

[54] MANUFACTURE OF THICK ALUMINUM ALLOY PLATE

[75] Inventors: Alfred J. P. Haszler, Vallendar; Alfred L. Heinz, Niederahr; Otmar M. Müller, Koblenz, all of Germany

[73] Assignee: Hoogovens Aluminium Walzprodukte GmbH, Koblenz, Germany

[21] Appl. No.: 588,026

[22] Filed: Jan. 17, 1996

[30] Foreign Application Priority Data

Jan. 19, 1995 [EP] European Pat. Off. ..... 95200134
May 12, 1995 [EP] European Pat. Off. ..... 95201243

[51] Int. Cl.[6] ..... C22F 1/04; C22F 1/053; C22F 1/00

[52] U.S. Cl. ..... 148/692; 148/691; 148/692; 148/696

[58] Field of Search ..... 148/691, 692, 148/696

[56] References Cited

U.S. PATENT DOCUMENTS 2,080,641 5/1937 Templin ..... 148/696
4,511,409 4/1985 Ferton et al. ..... 148/2
4,721,537 1/1988 Ghosh ..... 148/12.7
5,277,719 1/1994 Kuhlman et al. ..... 148/694
5,496,426 3/1996 Murtha et al. ..... 148/692

FOREIGN PATENT DOCUMENTS 2529578 6/1982 France .

*Primary Examiner*—David A. Simmons
*Assistant Examiner*—M. Alexandra Elve
*Attorney, Agent, or Firm*—Stevens, Davis, Miller & Mosher, L.L.P.

[57] ABSTRACT

Process for manufacturing thick aluminum alloy plate having improved properties comprising the hot deformation of an ingot, wherein the hot deformation comprises the combination of at least one hot rolling operation, and at least one forging operation, in which at least one of the hot rolling and forging operations is at least partly executed in the width direction.

32 Claims, 3 Drawing Sheets

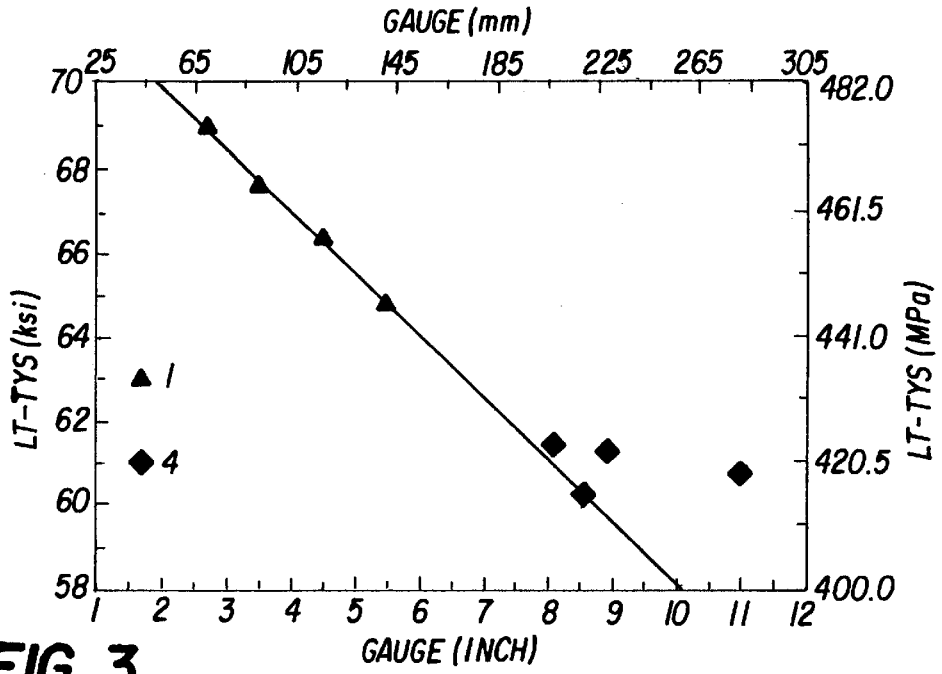
FIG. 3
FIG. 4
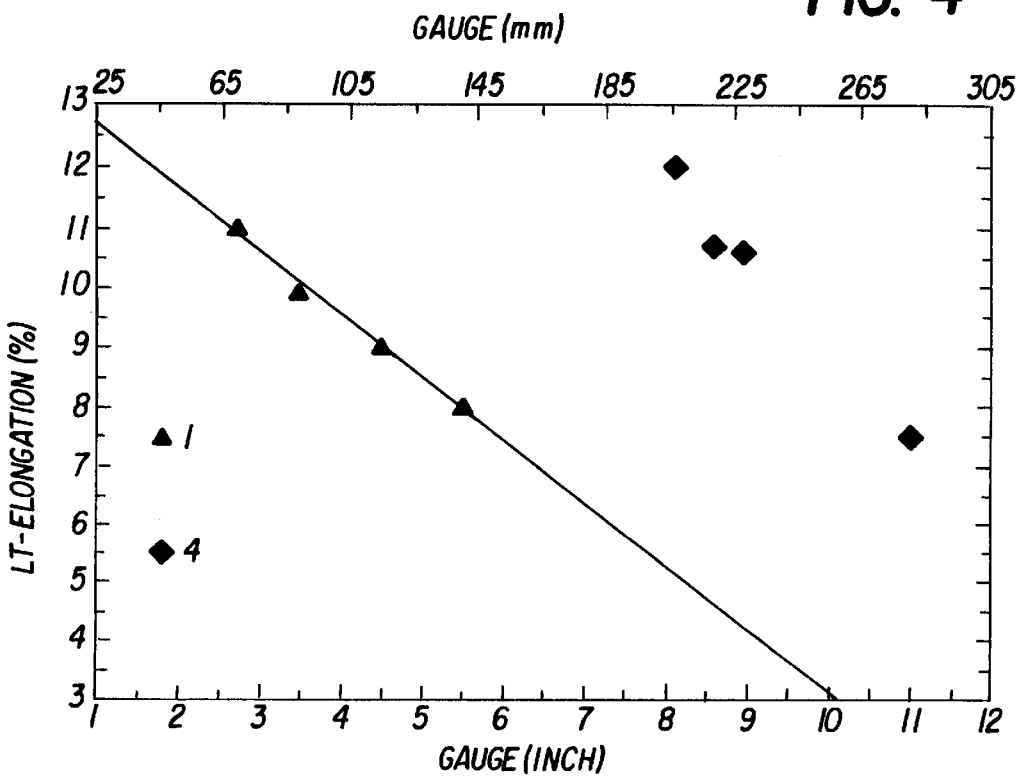

MANUFACTURE OF THICK ALUMINUM ALLOY PLATE

FIELD OF THE INVENTION

The invention relates to processes for manufacturing thick aluminum alloy plate having improved properties, by hot deformation of an ingot. The invention also relates to plate so manufactured.

DESCRIPTION OF THE PRIOR ART

An important field of use of thick aluminum alloy plate is aircraft and aerospace applications. For those applications, fatigue properties, representing the number of starts and landings of the aircraft, as well as the mechanical properties of the thick plate are of major importance. With improved properties of the thick plate weight reductions can be obtained. For other applications the mechanical properties are important as well.

For the purpose of this specification and claims thick plate is plate with a thickness of at least 2 inches (5 cm). It is known in the art that the fatigue properties are reduced at larger gauges. In the present state of the art a thickness of 6 inches (15 cm) is about the limit in which acceptable fatigue properties can be produced.

U.S. Pat. No. 5,277,719 discloses that the fatigue properties in a 5.7 inch (14 cm) thick plate can be improved by forging in the thickness direction of the plate with a thickness reduction of at least 30%. The specific process described and claimed consists of forging in the thickness direction followed by rolling in the thickness direction, but it is briefly mentioned, without process detail and without indications of any results, that forging may be performed in the width direction.

In European Patent Application 95201483.5 and U.S. Ser. No. 08/466,114 it has been described that the fatigue properties of a 6 inch (15 cm) thick plate can be improved by certain measures during casting of the ingot and/or during the hot rolling thereof.

In aircraft industries there is a need for plate of more than 6 inches (15 cm) having good properties, to allow fabrication of certain parts therefrom cheaply, instead of using forged parts.

SUMMARY OF THE INVENTION

A first object of the invention is to provide a process for manufacturing thick aluminum alloy plate having improved properties.

A second object of the invention is to provide thick aluminum alloy plate with a thickness of more than 2 inches (5 cm) having improved properties.

A third object of the invention is to newly provide thick aluminum alloy plate with a thickness of more than 6 inches (15 cm) having good properties.

The present invention can provide improved fatigue properties as well as improved mechanical properties, but its results will be primarily described in terms of fatigue properties.

According to the invention in one aspect there is provided a process for manufacturing thick aluminum alloy plate by hot deformation of an ingot, wherein the hot deformation comprises the combination of performing at least one hot rolling operation, and performing at least one forging operation, wherein at least one of the hot rolling and forging operations is at least partly executed in the width direction of the ingot, with the proviso that, in the case where forging in the width direction is followed by hot rolling, the forging in the width direction results in a final thickness dimension which is larger than the final width dimension.

According to the invention in a second aspect there is provided a process for manufacturing thick aluminum alloy plate by hot deformation of an ingot, wherein the hot deformation comprises the combination of performing at least one hot rolling operation, and performing at least one forging operation, wherein at least one of the hot rolling and forging operations is at least partly executed in the width direction of the ingot, and the manufactured plate has a thickness in the range 2–12 inches (5–30 cm) and a log-average fatigue life at 35 ksi of at least 150 kcycles.

For the sake of clarity, it is pointed out that hot rolling in the length direction (with elongation in length), hot rolling in the width direction (with elongation in width) and forging in the thickness direction are all process steps having the effect of decreasing thickness, whereas forging in the width direction has the effect of increasing thickness.

As may be seen from the test results given below the fatigue properties obtained by the processes of the invention are dramatically improved. It is thought that this is a result of executing at least partly at least one of the hot rolling and forging operations in the width direction. When thick plate is manufactured in a conventional way i.e. by hot rolling, the properties in the width direction, the so-called long transverse (LT) direction, are worse than the properties in the length direction. By forging the micro-structure and therewith the properties are generally improved. However, by executing one of the hot deformation operations in the width direction the properties in the width direction are particularly improved. By the combination of forging and hot rolling and by executing one of these operations in the width direction a very considerable improvement of the properties is obtained.

In a first preferred embodiment of the invention the hot deformation comprises:

hot rolling in the width direction, followed by forging in the thickness direction.

In this embodiment the hot deformation in the width direction is given in a first step of hot deformation by rolling and the second step of hot deformation comprises forging in the thickness direction.

In a second preferred embodiment of the invention the hot deformation comprises:

forging in the thickness direction, followed by hot rolling in the width direction.

In this embodiment the sequence of the steps of hot deformation of the first embodiment is reversed. In this second embodiment the hot rolling in the width direction may be followed by hot rolling in the length direction. In both the first and second preferred embodiments the hot deformation in the width direction is by rolling and the hot deformation by forging in the thickness direction is desirably limited to 30% to allow for a considerable hot deformation in the width direction.

In a third preferred embodiment of the invention the hot deformation comprises forging in width direction, followed by hot rolling.

In this embodiment the hot deformation in the width direction is, in contrast to the first and second embodiments, by forging. Preferably the forging in the width direction results in a thickness dimension which is larger than the width direction, thereby forming a new width direction being the former thickness direction, and a new thickness direction being the former width direction. The subsequent hot rolling may be in the new width direction and may be followed by hot rolling in the length direction.

Preferably in this third embodiment the thickness dimension in the new thickness direction is in the range 50% (more preferably 25%) greater than the thickness dimension in the former thickness direction to 15% (more preferably 5%) smaller than the thickness dimension in the former thickness direction.

Preferably in the second and third embodiments the thickness reduction by hot rolling is in the range of 10 to 50%. In this way, starting from usual ingot dimensions, thick plates of 6 inches (15 cm) or more are obtained.

In another aspect the invention is embodied in a thick aluminum alloy plate having a thickness in the range of 2–12 inches (5–30 cm) and having a log-average fatigue life at 35 ksi of at least 150 kcycles. Preferably the plate has a log-average fatigue life at 35 ksi of at least 300 kcycles and a thickness in the range of 6–12 inches (15–30 cm). A standard method of measuring log-average fatigue life for the purposes of the present invention is described below.

In still another aspect the invention is embodied in a thick aluminum alloy plate having a thickness in the range of 2–12 inches (5–30 cm) and having a fracture toughness relative to its thickness as given by the following formula: $K_{Ic}$ (T–L) >−1.2×G+31.2 in which $K_{Ic}$ (T–L) is the fracture toughness in the long transverse direction expressed in ksi $inch^{0.5}$ and G is the thickness of the plate expressed in inches. The values for the fracture toughness according to this aspect of the invention are to be found at the right side of the sloped line in FIG. 5.

The invention can provide plates having excellent properties with a thickness of 6–12 inches (15–30 cm), even 8–12 inches (20–30 cm).

The aluminum alloy of the thick plate is preferably an alloy of the AA 2000 or AA 7000 series. More preferably the alloy is one of AA 7010, AA 7049, AA 7149, AA 7050, AA 7150, AA 7055, AA 7064, AA 7075, AA 7175, AA 7475, AA 7076, AA 7178. More preferably the alloy contains by weight 5–9% Zn, 0.3–3% Cu, 1–3% Mg, max. 0.4% Si, max. 0.6% Fe, max. 0.5% Mn, max. 0.3% Zr, max. 0.3% Cr., max. 0.3% V, max. 0.3% Nb, max. 0.3% Hf and max. 0.5% Sc, the remainder Al and inevitable impurities.

BRIEF INTRODUCTION OF THE DRAWINGS

The invention will be illustrated by way of non-limitative example with reference to the drawings.

FIG. 3 shows the tensile yield strength of thick plate obtained by various processes relative to the thickness of the plate.

FIG. 4 shows the elongation of the thick plate obtained by various processes relative to the thickness of the plate.

EXAMPLES

Figure 1:
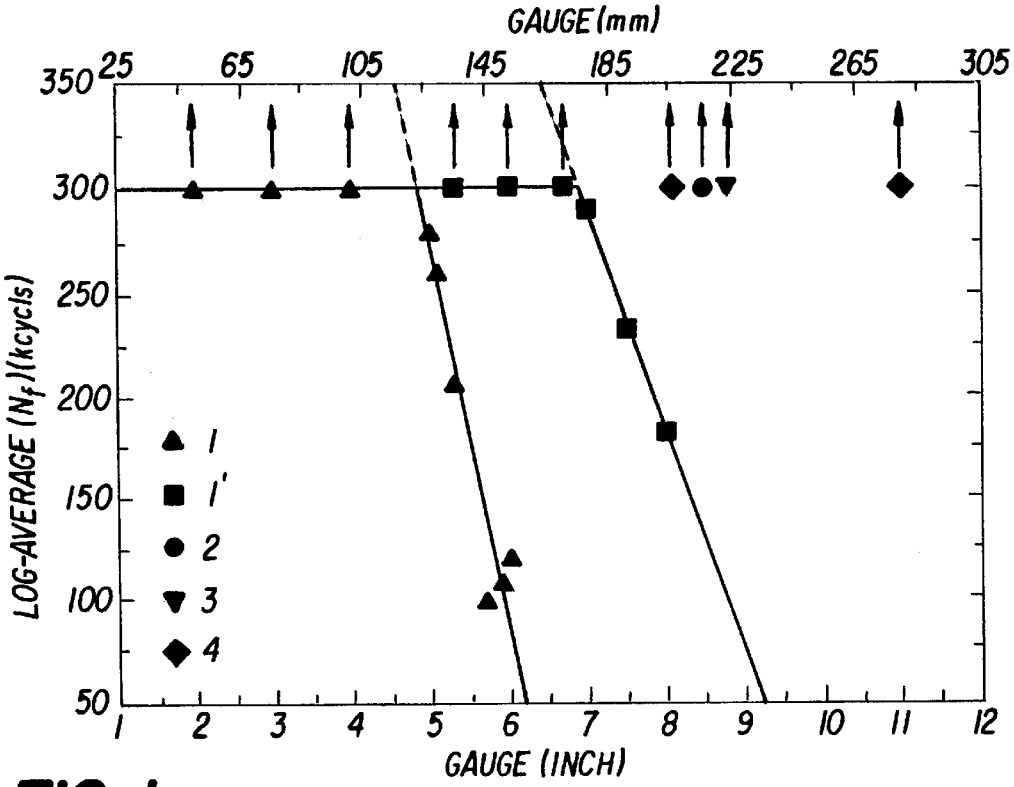
FIG. 1 shows the lifetime of thick plate obtained by various processes relative to the thickness of the plate at 35 ksi.
Figure 2:
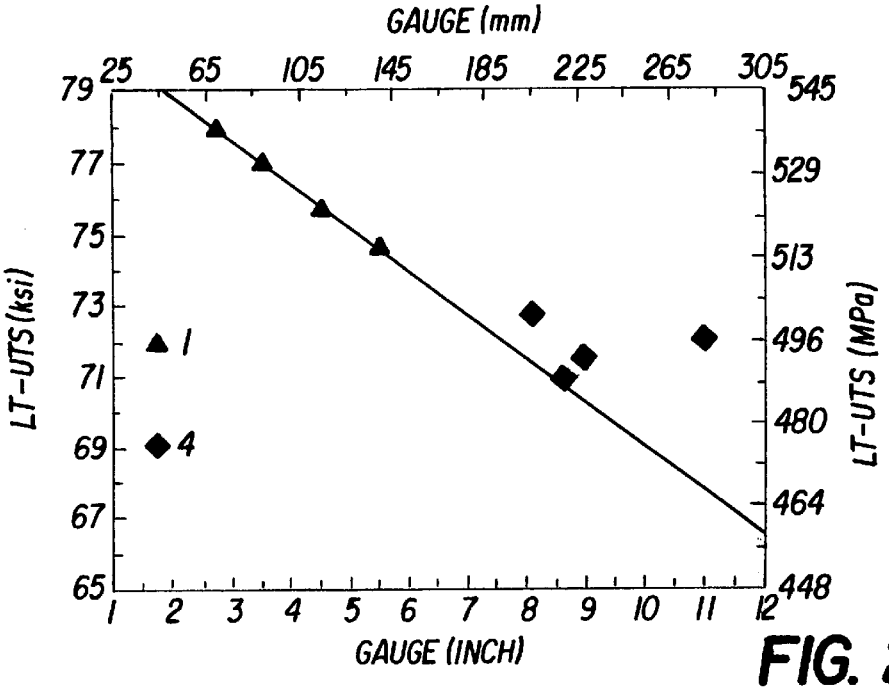
FIG. 2 shows the ultimate tensile strength of thick plate obtained by various processes relative to the thickness of the plate.
Figure 5:
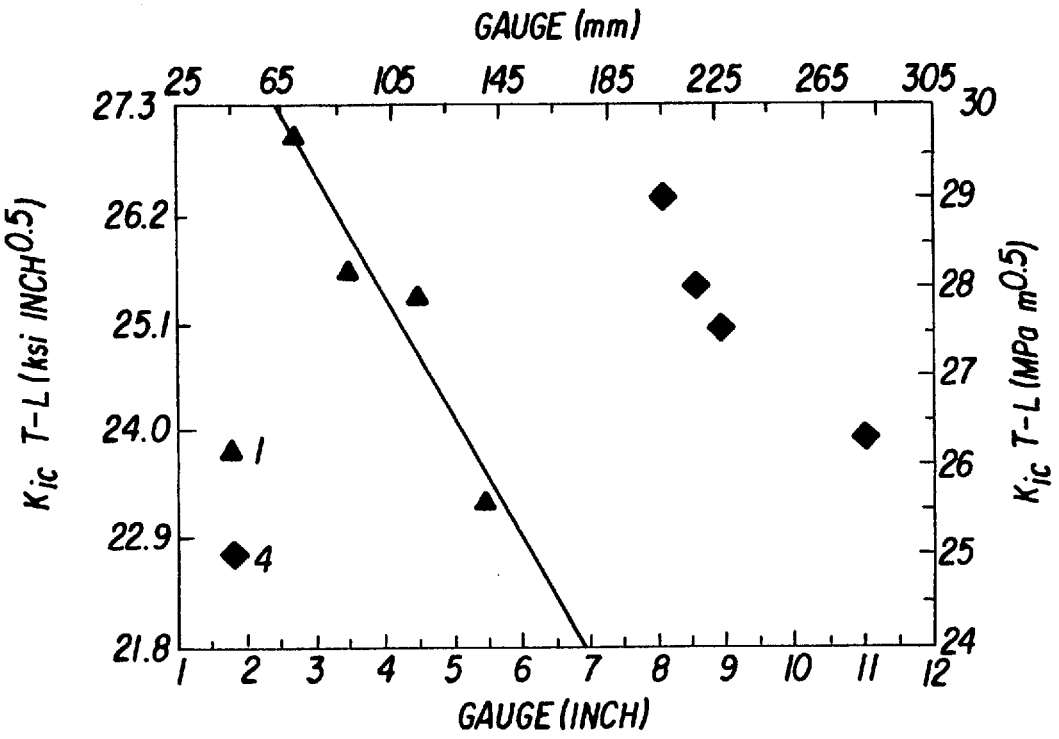
FIG. 5 shows the fracture toughness of thick plate obtained by various processes relative to the thickness of the plate.

AA 7050 T 7451 thick precursor plates were manufactured by casting ingots having, after scalping and sawing, a thickness of about 400 mm, a width in the range of 1070 to 1470 mm and a length in the range of 1700 to 3300 mm, followed by homogenization and preheating prior to hot deformation and solutionizing, quenching, stress relieving and aging.

The processes described below were performed on these precursor plates.

In process no. 1 (comparative) a thick plate with a thickness of 6.0 inches (15 cm) was manufactured in a conventional way by hot rolling in the length direction only.

In process no. 1' (comparative) a thick plate with a thickness of 6.7 inches (17 cm) was manufactured also by hot rolling in the length direction only. In process no. 1' the measures disclosed in European Patent Application 95201483.5 and U.S. Ser. No. 08/466,114 (the contents of which are herein incorporated by reference) were applied during casting and hot rolling.

In process no. 2 a thick plate with a thickness of 8.5 inches (21.5 cm) was manufactured by firstly hot rolling the ingot (precursor plate) in the width direction to an intermediate thickness of 288 mm, cooling to room temperature, reheating and forging in the thickness direction to a final thickness of 8.5 inches (21.5 cm). The thickness reduction by forging was less than 30%.

In process no. 3 a thick plate with a thickness of 8.8 inches (22 cm) was manufactured by firstly forging the ingot (precursor plate) in the thickness direction from 400 to 320 mm (thickness reduction about 20%), cooling to room temperature, reheating and hot rolling in the width direction to a thickness of 280 mm (thickness reduction of about 12%) and finally hot rolling in the length direction to a thickness of 8.8 inches (22 cm).

In process no. 4 a thick plate with a thickness of 11.0 inches (28 cm) was manufactured by firstly forging the ingot (precursor plate) in the width direction from 400 mm ×1300 mm (thickness ×width) into 800 mm ×400 mm (new width ×new thickness), cooling to room temperature, reheating and hot rolling in the length direction to a thickness of 11.0 inches (28 cm).

In these processes, conventional forging and rolling techniques are employed. Forging in the thickness direction may be performed step-wise with an overlapping length of about 50% of the forging tool, which is 200–600 mm wide. Forging in the width direction in process no. 4 was done in a single step from the original width of about 1300 mm down to about 500 mm. Depending of final temperature after that step the material was reheated again or not and then forged partially down to a final dimension of 400–500 mm.

Smooth axial fatigue tests were performed in accordance with ASTM E466 at a stress level of 35 and 40 ksi (241 and 275 MPa), respectively, using a stress ratio of R=0.1 and a frequency of 20 Hz. Testing conditions were dry laboratory air (relative humidity 30–50%) and room temperature. The specimens were excised from the mid-width and mid-thickness position in the LT-direction with a parallel gauge length of 2 inches (50.8 mm) and a gauge diameter of 0.5 inches (12.7 mm). The minimum and log-average of fatigue life for a set of 4 specimens per plate are given in Table 1 and FIG. 1 for 35 ksi and in Table 2 for 40 ksi respectively. The tests were terminated at 300,000 cycles if failure did not occur. Four specimens were tested per lot.

TABLE 1

| Property | | Maximum Stress: 35 ksi | | | | |
|---|---|---|---|---|---|---|
| | | Process No. and Gauge [inches] | | | | |
| | | No. 1 6.0 | No. 1' 6.7 | No. 2 8.5 | No. 3 8.8 | No. 4 11.0 |
| minimum fatigue life per lot | [cycles] | 101,010 | 300,000 | 300,000 | 300,000 | 300,000 |
| log-average fatigue life per lot | [cycles] | 119,801 | 300,000 | 300,000 | 300,000 | 300,000 |
| number of runouts | | 0 | 4 | 4 | 4 | 4 |

TABLE 2

| Property | | Maximum Stress: 40 ksi | | | | |
|---|---|---|---|---|---|---|
| | | Process No. and Gauge [inches] | | | | |
| | | No. 1 6.0 | No. 1' 6.7 | No. 2 8.5 | No. 3 8.8 | No. 4 11.0 |
| minimum fatigue life | [cycles] | 81,378 | 145,518 | 300,000 | 140,241 | 300,000 |
| log-average fatigue life | [cycles] | 92,143 | 233,656 | 300,000 | 168,733 | 300,000 |
| number of runouts | | 0 | 2 | 4 | 0 | 4 |

From Tables 1 and 2 it appears that the lifetimes of the plates made by the processes no. 2, 3 and 4 in accordance with the invention are all better than the lifetime of the plate made in the conventional way of process no. 1. This also holds true for the plate made by the process no. 1'. However from Table 2 it appears that the plate of process no. 3 is worse than the plates of processes no. 2 and 4. This is attributed to the very limited hot deformation in the width direction given in the example process no. 3. From Table 2 it seems that the plate of process no. 3 is even worse than process no. 1', but this is due to the fact that it is also much thicker. As will be discussed later on it can be concluded from FIG. 1 that process no. 3 generally results in a much better fatigue performance than process no. 1'.

In the processes 2, 3 and 4 the hot deformation was executed to obtain thick plates of 8.5, 8.8 and 11.0 inches (21.5, 22, 28 cm) respectively but it is evident that the hot deformation in processes 2, 3 and 4 is not limited to such thicknesses and can be varied to obtain smaller gauges of 6 inches (15 cm) and less having improved fatigue and mechanical properties.

It is also evident that the processes 2, 3 and 4 may be varied in a considerable degree also giving improved properties as long as those variations satisfy the condition that at least one of the hot rolling and forging operations are at least partly executed in the width direction.

In FIG. 1 the lifetime results obtained by applicant at 35 ksi of thick plates manufactured by the processes 1, 1', 2, 3 and 4 are brought together. Symbols relate to the processes mentioned. FIG. 1 contains not only results described above but also further results for various thicknesses.

It is observed that the log-average values of the conventional process no. 1 shows a sharp breakdown at a thickness of about 6 inches (15 cm). In fact from the state of the art, there are no test values known for a thickness beyond 6 inches (15 cm). The horizontal line of process no. 1 at 300 kcycles represents that the tests were terminated at 300 kcycles. Actual values are unknown but are above 300 kcycles as indicated by arrows. As a first approximation the sloped line of process no. 1 might be extrapolated as indicated by the dotted line to represent those unknown values.

Apparently it is not possible to obtain plates with an acceptable lifetime by process 1 with a thickness beyond 6 inches (15 cm).

The sloped line representing process 1' represents already a substantial improvement for thick plates up to about 9 inches (23 cm).

FIG. 1 shows clearly improvement of fatigue properties achieved by processes no. 2, 3 and 4 resulting in log-average values of over 300 kcycles at 35 ksi for plates 8.5, 8.8 and 11 inches (21.5, 22, 28 cm) thick respectively. This means that the decline in lifetime as with processes 1 and 1' is for process 2 beyond a thicknesses of 8.5 inches (21.5 cm), and for processes 3 and 4 beyond thicknesses of 8.8 and 11 inches (22, 28 cm) respectively.

As mentioned above not only the fatigue properties, but also the mechanical properties are improved by the process of the invention. This is shown in FIGS. 2, 3, 4 and 5 relating to the ultimate tensile strength UTS, the 0.2% tensile yield strength TYS, the elongation and the fracture toughness $K_{Ic}$ respectively all in the LT, i.e. the width direction, for thick aluminum alloy plate of process no. 4. In each of the figures there is shown with a sloped line the value of the respective mechanical property according to the state of the art represented by process no. 1 relative to the plate thickness. It appears that the mechanical properties of the thick plate of process no. 4 are greatly improved relative to the state of the art as far as the elongation and toughness is concerned (see FIGS. 4 and 5) and to a lesser extent for the strength values (see FIGS. 2 and 3).

While the invention has been illustrated by these Examples, it is not limited to them, and encompasses all embodiments including the inventive concept.

What is claimed is:

1. A process for manufacturing thick aluminum alloy plate by hot deformation of an ingot, wherein the hot deformation comprises the combination of performing at least one hot rolling operation, and performing at least one forging operation, wherein at least one of said hot rolling and forging operations is at least partly executed in the width direction of the ingot, with the proviso that, in the case where forging in the width direction is followed by hot rolling, the forging in the width direction results in a final thickness dimension which is larger than the final width dimension and with the further proviso that the steps of the invention do not include an upsetting step.

2. Process according to claim 1 wherein said hot deformation comprises (a) the step of hot rolling in the width direction, followed by (b) the step of forging in the thickness direction.

3. Process according to claim 2, wherein in said step (b) the thickness reduction is less than 30%.

4. Process according to claim 1 wherein said hot deformation comprises (a) the step of forging in the thickness direction, followed by (b) the step of hot rolling in the width direction.

5. Process according to claim 4 wherein said step (b) is followed by (c) hot rolling in the length direction.

6. Process according to claim 4, wherein in said step (a) the thickness reduction is in the range of 10 to 30%.

7. Process according to claim 4, wherein the thickness reduction by hot rolling is in the range of 10 to 50%.

8. Process according to claim 1 wherein said hot deformation comprises (a) the step of forging in width direction, followed by (b) the step of hot rolling wherein said step (a) results in a final thickness dimension which is larger than the final width direction, thereby forming a new width direction being the former thickness direction, and a new thickness direction being the former width direction.

9. Process according to claim 8 wherein said step (b) comprises the step of (b1) hot rolling in said new width direction.

10. Process according to claim 9 wherein said step (b) further includes, following said step (b1), the step of (b2) hot rolling in the length direction.

11. Process according to claim 8 wherein in said step (a), the thickness dimension in said new thickness direction is in the range 50% greater than the thickness dimension in said former thickness direction to 15% smaller than said thickness dimension in said former thickness direction.

12. Process according to claim 10 wherein in said step (b), there is performed a thickness reduction in the range of 10 to 50%.

13. Process according to claim 1 wherein the aluminum alloy is an alloy of the AA 2000 or AA 7000 series.

14. Process according to claim 13 wherein the aluminum alloy is selected from the group consisting of AA 7010, AA 7049, AA 7149, AA 7050, AA 7150, AA 7055, AA 7064, AA 7075, AA 7175, AA 7475, AA 7076 and AA 7178.

15. Process according to claim 13 wherein the aluminum alloy contains by weight 5–9% Zn, 0.3–3% Cu, 1–3% Mg, max. 0.4% Si, max. 0.6% Fe, max. 0.5% Mn, max. 0.3% Zr, max. 0.3% Cr., max. 0.3% V, max. 0.3% Nb, max. 0.3% Hf and max. 0.5% Sc, remainder Al and inevitable impurities.

16. A process for manufacturing thick aluminum alloy plate by hot deformation of an ingot, wherein the hot deformation comprises the combination of:

performing at least one hot rolling operation, and performing at least one forging operation, wherein at least one of the hot rolling and forging operations is at least partly executed in the width direction of the ingot, and the manufactured plate has a thickness in the range 2 to 12 inches (5 to 30 cm) and a log-average fatigue life at 35 ksi of at least 150 kcycles, with the proviso that the steps of the invention do not include an upsetting step.

17. Process according to claim 16 wherein the thick aluminium alloy plate has a log-average fatigue life at 35 ksi of at least 300 kcycles.

18. Process according to claim 17 wherein said hot deformation comprises (a) the step of hot rolling in the width direction, followed by (b) the step of forging in the thickness direction.

19. Process according to claim 18, wherein in said step (b) the thickness reduction is less than 30%.

20. Process according to claim 19 wherein said hot deformation comprises (a) the step of forging in the thickness direction, followed by (b) the step of hot rolling in the width direction.

21. Process according to claim 20 wherein said step (b) is followed by (c) hot rolling in the length direction.

22. Process according to claim 21, wherein in said step (a) the thickness reduction is in the range of 10 to 30%.

23. Process according to claim 22, wherein the thickness reduction by hot rolling is in the range of 10 to 50%.

24. Process according to claim 23 wherein said hot deformation comprises (a) the step of forging in width direction, followed by (b) the step of hot rolling wherein said step (a) results in a final thickness dimension which is larger than the final width direction, thereby forming a new width direction being the former thickness direction, and a new thickness direction being the former width direction.

25. Process according to claim 24 wherein said step (b) comprises the step of (b1) hot rolling in said new width direction.

26. Process according to claim 25 wherein said step (b) further includes, following said step (b1), the step of (b2) hot rolling in the length direction.

27. Process according to claim 26 wherein in said step (a), the thickness dimension in said new thickness direction is in the range 50% greater than the thickness dimension in said former thickness direction to 15% smaller than said thickness dimension in said former thickness direction.

28. Process according to claim 27 wherein in said step (b), there is performed a thickness reduction in the range of 10 to 50%.

29. Process according to claim 16 wherein the aluminum alloy is an alloy of the AA 2000 or AA 7000 series.

30. Process according to claim 29 wherein the aluminum alloy is s elected from the group consisting of AA 7010, AA 7049, AA 7149, AA 7050, AA 7150, AA 7055, AA 7064, AA 7075, AA 7175, AA 7475, AA 7076 and AA 7178.

31. Process according to claim 29 wherein the aluminum alloy contains by weight 5–9% Zn, 0.3–3% Cu, 1–3% Mg, max. 0.4% Si, max. 0.6% Fe, max. 0.5% Mn, max. 0.3% Zr, max. 0.3% Cr., max. 0.3% V, max. 0.3% Nb, max. 0.3% Hf and max. 0.5% Sc, remainder Al and inevitable impurities.

32. A process for manufacturing thick aluminum alloy plate by hot deformation of an ingot, wherein the hot deformation consists of:

performing at least one hot rolling operation, and performing at least one forging operation, wherein at least one of said hot rolling and forging operations is at least partly executed in the width direction of the ingot, with the proviso that, in the case where forging in the width direction is followed by hot rolling, the forging in the width direction results in a final thickness dimension which is larger than the final width dimension.

* * * * *